United States Patent [19]

Greeson, Jr.

[11] Patent Number: 4,524,352

[45] Date of Patent: Jun. 18, 1985

[54] HIGH FREQUENCY PILOT

[75] Inventor: James C. Greeson, Jr., Woodstock, N.Y.

[73] Assignee: International Business Machines Corporation, Armonk, N.Y.

[21] Appl. No.: 385,183

[22] Filed: Jun. 4, 1982

[51] Int. Cl.[3] ..... G09G 3/28

[52] U.S. Cl. ..... 340/714; 340/713; 340/771; 315/169.4

[58] Field of Search ..... 340/713, 714, 771; 315/169.1, 169.4

[56] References Cited

U.S. PATENT DOCUMENTS

| | | | |
|---|---|---|---|
| 3,609,658 | 9/1971 | Soltan | 340/714 |
| 3,644,925 | 2/1972 | Kupsky | 340/714 |
| 3,786,484 | 1/1974 | Miavecz | 340/714 |
| 3,832,706 | 8/1974 | Reboul et al. | 340/714 |
| 3,877,006 | 4/1975 | Reboul et al. | 340/714 |
| 3,982,155 | 9/1976 | Fein | 340/714 |
| 4,296,357 | 10/1981 | Hirayama et al. | 340/713 |

*Primary Examiner*—Marshall M. Curtis

*Attorney, Agent, or Firm*—Joseph J. Connerton

[57] ABSTRACT

In a plasma display panel consisting of gas enclosed between adjacent insulating members having conductors thereon insulated from the gas, a light source in the panel is used to condition all cells to permit selected orthogonal conductors to constitute a display. The light source is actuated prior to a write operation by a high frequency signal whereby all areas of the panel are simultaneously conditioned. The light source may comprise one or more pilot cells positioned adjacent to but not within the display areas. By conditioning all cells simultaneously, higher speed and uniform selection operation is effected.

8 Claims, 2 Drawing Figures

HIGH FREQUENCY PILOT

CROSS REFERENCE TO RELATED PATENT APPLICATIONS

U.S. application Ser. No. 372,384 "Improved Method and Apparatus for Gas Display Panel" filed by Tony N. Criscimagna et al. June 21, 1973.

BACKGROUND OF THE INVENTION

1. Field of the Invention

This invention relates to plasma display devices and more particularly to an improved means for conditioning such devices prior to a write operation.

2. Description of the Prior Art

The use of a light source designated a pilot light to facilitate discharge of a plasma display device is well known in the art, and is disclosed, for example, in U.S. Pat. No. 3,609,658, "Pilot Light Gas Cells for Gas Panels" issued to Parviz Solton Sept. 28, 1971, hereinafter designated the '658 patent. The device disclosed in the '658 patent employs one or more light sources designated pilots incident to the panel. While the theoretical physics of the operation of a plasma device is not universally accepted, it is believed that the photons emitted by the pilot cell or cells provide or activate the charge particles necessary for discharge, thereby conditioning the panel for a write operation.

Despite an independent power supply, it was discovered that the pilot in the '658 patent had an inherent starting problem, particularly in a dark environment, or after it had not been ignited over an extended period. This problem was solved by using a small radioactive source such as Nickel 63 positioned in the vicinity of the pilot cell which emits beta radiation sufficient to facilitate initial firing of the pilot cell when a drive signal was applied thereto. This teaching is embodied in U.S. Pat. No. 3,928,781 "Gaseous Discharge Display Panel Including Pilot Electrodes and Radioactive Wire" issued to Roger Joseph Edwards et al. Dec. 23, 1975, hereinafter designated the '781 patent. Both of the above referenced patents are assigned to the assignee of the instant invention.

While the above described '781 operation was adequate for smaller size lower resolution panels, the time at which the various electrodes were conditioned for a write operation varied as some functions of the distance from the pilot cells which were positioned either at the corner or on horizontal rows above and/or below the viewing area of the panel. The cells farthest from the border took longer to condition than those adjacent the border such that optimum write pulse timing varied as a function of distance from the border. In small gas panels such as those described in the '658 and '781 patents, the use of a pilot configuration above and below the data area and the relatively small data areas allowed this variation in conditioning times to be tolerated. However, in panels of substantial size and high resolution, faster update times are required and the piloting action was substantially inferior in the center of the panel when well timed for the edges and vice-versa. This situation could not be tolerated, since practical addressing systems are based on all cells having the required conditioning simultaneously. Finally, disposal of panels containing the radioactive wire disclosed in the '781 patent was covered by Federal and/or state regulations, further adding to the cost of the device.

SUMMARY OF THE INVENTION

In accordance with the instant invention, there is provided an improved piloting system for conditioning a large size high resolution plasma display panel. As described above, the problems of conditioning all cells are particularly acute in a large size high resolution panel. To overcome these varied problems, the frequency of the piloting signal, instead of corresponding to the sustain frequency as in conventional system, is set high as compared to the sustain frequency. The high frequency pilot system is controlled by the same control signals as those controlling the write function. High frequency pilot pulses are directed onto the panel on each alternation of the pilot, thereby providing the essential conditioning over the entire panel area irrespective of the distance between the pilot and any cell within the panel. Thus, the cells at the center of the panel are conditioned substantially simultaneously with cells adjacent to the pilot cells. In a preferred embodiment constructed in accordance with the teaching of the instant invention, a frequency equal to approximately 10 times that of the sustain signal was employed, while a row of cells above and below the display area was selected as the pilot configuration. The pilot cells were formed as part of the panel fabrication, thus contributing to the low cost.

DESCRIPTION OF THE PREFERRED EMBODIMENT

Figure 1:
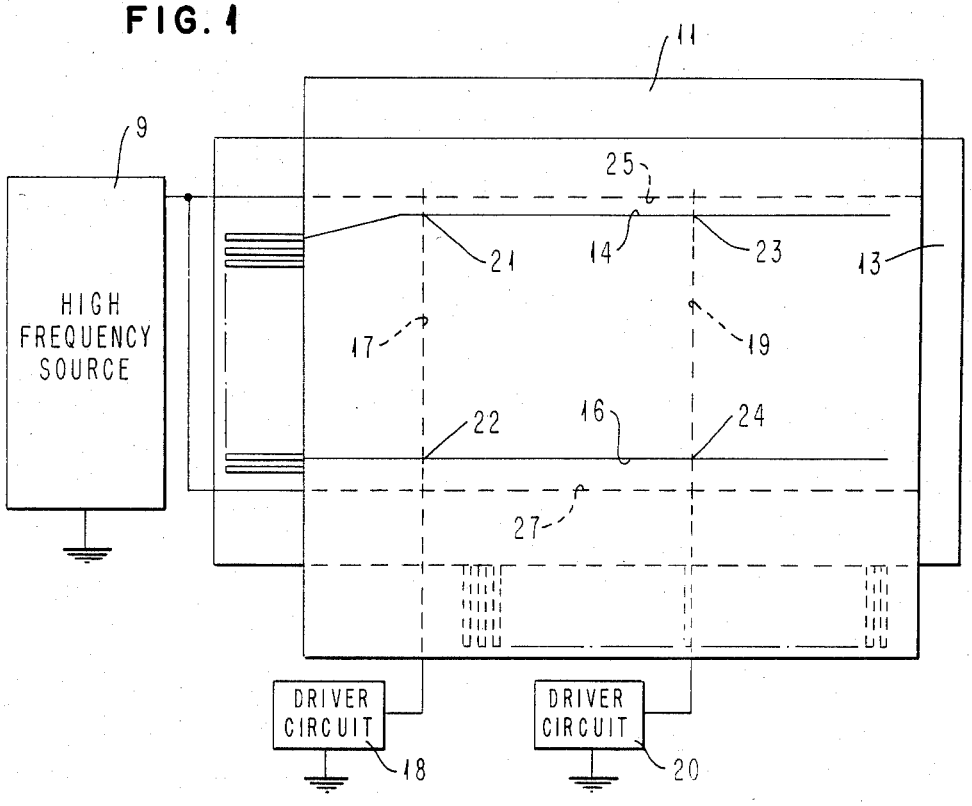
FIG. 1 is a top view illustration of a preferred embodiment of the invention.

Referring now to the drawings and more particularly to FIG. 1 thereof, a high frequency pilot source 9 is connected to a plasma display or gas panel, terms used interchangeably, comprising a pair of gas plates 11 and 13 which, when edge sealed, form an envelope filled with an illuminable gas. Within the panel and positioned on the interior side of the glass plates are orthogonal conductor arrays, the respective intersections of which define the individual cells of the plasma display. Conductors such as 14, 16 on the front plate 11 illustrate the horizontal conductor arrays, while conductors 17, 19 on the rear plate 13 illustrate the vertical arrays, the vertical arrays being connected through to driver circuits 18, 20 respectively to a reference potential. Cells 21–24 comprising the cells defined by the conductor intersections.

Not visible on the drawings but essential to the operation of plasma display devices are transparent dielectric overcoats which insulate the conductor arrays from the gas. When a pair of drive signals or a single drive signal and a reference potential are selectively applied to pairs of orthogonal conductors, a localized discharge occurs at the intersections, and a wall charge potential opposite to the discharge potential occurs thereat. This wall charge potential combines with a lower potential sustain signal to maintain the selected display by continuous discharge at the sustain frequency. One of the problems in the early gas panel development related to the aging of the dielectric caused by ion bombardment of the lead-oxide dielectric surface during discharge. This problem was solved by using a coating of a refractory material over the dielectric surface to protect the dielectric surface during discharge. For further details of panel fabrication, reference is made to U.S. Pat. No. 3,837,724 "Gas Panel Fabrication" issued to Peter H. Haberland et al, Sept. 24, 1974. For the method and apparatus for driving a plasma display in sustain, write and erase modes, reference is made to the aforenoted Criscimagna et al U.S. application Ser. No. 372,384. The '384 application also addresses and fires the pilot lights which are described as positioned in the four corners of the display. The above description represents background information which facilitates an understanding of the present invention but is not considered a part thereof. The above identified '724 patent and '384 application are assigned to the assignee of the instant invention, and are incorporated herein for any necessary background information.

Referring back to FIG. 1, it has been previously noted that in large size plasma panels, the conventional piloting action was substantially inferior in the center when well timed at the edge and vice-versa. This problem has been overcome in the instant invention, wherein two horizontal rows 25, 27 of pilot cells above and below the display area respectively are formed as part of the fabrication process. The vertical component of the pilot cells in the preferred embodiment is referenced to a fixed voltage such as 200 volts d.c. A single sustain voltage of 200 volts and a reference level of ground potential are contemplated in the driving system provided herein. Accordingly, the pilot reference can be connected to the sustain signal to further simplify the design.

Figure 2:
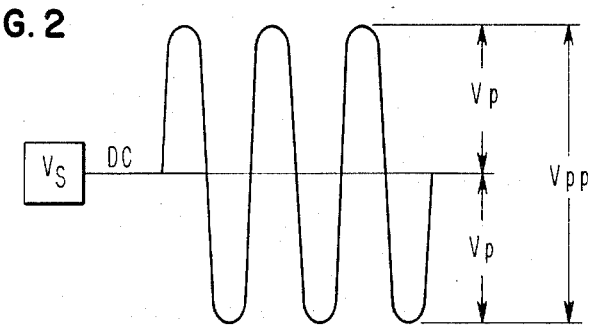
FIG. 2 is a series of waveforms illustrating in time sequence the operation of the instant invention.

When a selective write signal is generated as described in the '384 application, the control logic will apply the high frequency source to the pilot cells whereby pilot pulses are directed into the panel on each high frequency alternation, thereby providing the appropriate stimulation or conditioning irrespective of the distance to the cell in question. While a single high frequency pulse should suffice, a sequence of pulses, 3 in the preferred embodiment as shown in FIG. 2, are generated. Since the pilot is operating at a frequency approximately 10× that of the sustain frequency, three pilot pulses require only three tenths of a normal sustain cycle. It should be appreciated that while only one pulse is required, any number of pilot pulses can be generated.

Since the details of the high frequency oscillator are not essential to an understanding of the subject invention, a specific design is not described. However, advantage can be taken of the inherent capacity of the plasma panel to provide a tuned circuit, so that the power dissipated by the pilot oscillator is very low. Similarly, the time during which the pilot oscillator is on can be controlled. For a treatise on the capacitive effect of a gas panel, reference is made to U.S. Pat. No. 3,559,190 issued to Donald L. Bitzer et al Jan. 26, 1971. Alternatively, any type of high frequency generator may be employed. Finally, a single power pilot similar to 20, 22 in FIG. 1 of the referenced '781 patent positioned in the corner of the panel could be employed to function as a backup to ensure conditioning of the appropriate high frequency pilot.

While the invention has been particularly shown and described with reference to a preferred embodiment thereof, it will be understood by those skilled in the art that various changes in form and detail may be made therein without departing from the spirit and scope of the invention.

Having thus described my invention, what I claim as new, and desire to secure by Letters Patent is:

1. In a plasma display device comprising a plurality of display cells defined by the intersection of coordinate conductors disposed on opposite sides of a gas panel and means for discharging said display cells in response to the selective application of write signals thereto, said coordinate conductors having a dielectric coating insulating them from contact with said gas, said dielectric coating comprising a layer of refractory material disposed thereover to eliminate aging of the surface of said dielectric by ion bombardment of said dielectric surface during discharge of said display cells, the improvement comprising at lease one pilot cell, said pilot cell comprising first and second electrodes connected to a high frequency drive source, said pilot cell being positioned within the non-display area of said panel, the light output of said high frequency pilot cell conditioning said display cells irrespective of their location in the panel immediately prior to said write signals being applied thereto.

2. A plasma display device of the type claimed in claim 1 wherein said second electrode comprises a display electrode.

3. A plasma display device of the type claimed in claim 2 wherein said second electrode comprises a second pilot electrode.

4. A plasma display device of the type claimed in claim 1 wherein said at least one pilot cell comprises a plurality of pilot cells positioned in a horizontal row.

5. A plasma display device of the type claimed in claim 4 wherein one horizontal row is positioned at the top and a second at the bottom rows of said display device and located in the non-display border areas.

6. A plasma display device of the type claimed in claim 1 wherein the said other of said electrodes connected to reference potential comprises said second electrode and its associated drive circuitry, said second electrode being disposed orthogonally to said pilot electrode, said associated drive circuitry comprises a driver referenced to said reference potential.

7. A plasma display device of the type claimed in claim 1 wherein said high frequency source comprises a multiple of the sustain frequency required to maintain said display.

8. A plasma display device of the type claimed in claim 1 wherein said pilot cell is located adjacent to the display area of said device.

* * * * *